US005988299A

United States Patent [19]

Hansen et al.

[11] Patent Number: 5,988,299

[45] **Date of Patent: *Nov. 23, 1999**

[54] AUTOMATED OIL RIG SERVICING SYSTEM

[76] Inventors: James Hansen, 3708 S. Real Rd., Bakersfield, Calif. 93309; Louis E. Witte, 6300 Seven Seas Ave., Bakersfield, Calif. 93306

[ * ] Notice: This patent is subject to a terminal disclaimer.

[21] Appl. No.: 08/623,041

[22] Filed: Mar. 28, 1996

Related U.S. Application Data

[63] Continuation-in-part of application No. 08/506,955, Jul. 26, 1995, Pat. No. 5,711,382.

[51] Int. Cl.[6] ..... E21B 19/20

[52] U.S. Cl. ..... 175/52; 175/85

[58] Field of Search ..... 175/20, 24, 52, 175/85, 203; 414/22.61, 22.62, 22.63

[56] References Cited

U.S. PATENT DOCUMENTS

| | | | |
|---|---|---|---|
| 4,604,724 | 8/1986 | Shaginian et al. | 175/24 |
| 4,765,401 | 8/1988 | Boyadjieff | 175/52 |
| 4,901,805 | 2/1990 | Ali-Zade et al. | 175/52 |
| 5,711,382 | 1/1998 | Hansen et al. | 175/52 |

*Primary Examiner*—William Neuder
*Attorney, Agent, or Firm*—David O'Reilly

[57] ABSTRACT

An automated well servicing system comprised of computer controlled tong assemblies, a remote controlled robotic racking system and unique slips and backup clamps. The system has a pair of tong assemblies for automatically disconnecting or connecting rods or tubes. Each tong assembly is pivotally mounted on the frame of a vehicle for deployment once the vehicle is parked at a well head and includes power tongs, backup clamps and slips mounted on hydraulically operated carriers for positioning over a well head. A robotic rod tubular handler controlled by a joy stick mounted on the waist of a floor man permits remote racking of rods and tubes. A slip assembly is provided comprised of a pair of housings forming a conical cavity and a conical mandrel having pins or slugs that clamp a tubular string when the two housings are pressed together. The slips are also constructed to maintain the clamping force on a string until a hoist and elevator lifts the string a short distance activating a proximity switch to release the string. The system also includes a unique elevator head having interchangeable plates to change the system from handling rods to handling tubes.

28 Claims, 13 Drawing Sheets

AUTOMATED OIL RIG SERVICING SYSTEM

This application is a continuation-in-part of Ser. No. 08/506,955 filed Jul. 26, 1997 now U.S. Pat. No. 5,711,382.

BACKGROUND OF THE INVENTION

1. Field of the Invention

This invention relates to automated oil servicing equipment and more particularly, relates to utility equipment to automatically service oil wells and increase well servicing efficiency.

2. Background Information

It was not long ago that service rigs, for oil wells, required a crew of four to set-up and service the well. However, with the advent of tube and rod tongs, the crew was reduced to three.

The typical oil rig servicing system requires a rig operator who runs the hoisting operation and also the slips and tongs. A floor man handles the tubes that are being hoisted and placed in a racking board. A third workman, called a "derrick man", on a platform, racks the tubulars in the racking board.

In the oil rig servicing environment, accidents are frequent enough to be costly and significantly damage the public image of the oil industry. These factors have lead to the increasing desire to create automated systems for servicing oil wells.

Over the years there have been a number of attempts at automation. One such attempt was a completely automated drilling rig built by a company called Automatic Drilling Machine (ADM) in the late 1960's that was considered somewhat successful. Improved models of this drilling rig, however, did not have any success. Another attempt at automation is described in the October 1987 issue of Off Shore Magazine on Pg. 53. The article describes a new pipe handling unit and drilling tower. The robotic pipe handling unit was developed by a company called Tempco Drilling Products. The robotic pipe handling unit moves pipe to and from a finger board and rotary without human intervention. The robot is rail mounted to a drill floor and not connected to a derrick, which presumably is supposed to provide greater safety. A computer, positioned away from the drill floor, assists in controlling the unit. A control console is positioned at a driller's station. The machine is in the form of a tower with a hydraulic hoist machine which is supposedly easier to install than conventional derricks and is constructed to move pipe to and from a racking board. However, the success with the unit has not been achieved.

Another system is described in the July 1987 issue of Drilling Contractor and was developed by Varco International, Inc. Supposedly, the unit enables a single operator to execute all the pipe tripping functions from the floor to the monkey port. The unit consisted of a built-in stand make-up and break-up, which was supposed to eliminate equipment so an individual could perform these tasks. In operation, the operator supposedly could control each function manually using an observed position, or let automatic sequences take over with the unit controlled by its own microprocessor. To-date, this system has not been entirely successful.

An automated well servicing and drilling rig was disclosed and described in U.S. Pat. No. 4,591,006 of Hutchinson et al issued May 27, 1986 and owned by Chevron Research Company of San Francisco, Calif. However, this machine was never successful. It included a device that had a transfer system to transfer tubulars from a horizontal racking system for lowering or extracting tubulars from a well. The system included storage means, conveying and elevating individual elongated well elements such as pipe, tubing and rods from a storage position into a position with alignment with well bore. The system also included automated tongs for connecting and disconnecting well tubulars from a string within a well bore, and an automatic gripper in the form of slips to prevent longitudinal movement of the string. Automatic centralizing means were included for positioning the well elements with respect to the centerline of the well bore. The system was designed so that the overall apparatus could be stored on a mobile rig to be transportable, as a unit, from one well head to another.

It is therefore, one object of the present invention to provide an automated oil well servicing rig.

Yet another object of the present invention is to provide an automated oil well servicing rig having a remotely controlled racking system.

Still another object of the present invention is to provide an automated oil rigging system comprised of automated tongs for making and breaking pipes, rods and tubulars.

Still another object of the present invention is to provide an automated well servicing rig system having a remotely controlled robot for racking pipes and rods.

Yet another object of the present invention is to provide an oil well servicing rig that includes a remote controlled robot on a racking board some 25 feet above ground for remotely racking tubulars.

Yet another object of the present invention is to provide an automated well servicing rig known as an "Auto-rig" that includes an automated tong/slip assembly permanently mounted on the rig to handle pipe and rods.

Yet another object of the present invention is to provide an automated oil well servicing rig that allows the rig operator to run the hoisting operation as well as the slips and tongs. The tongs are automatically operated and require a minimum of the rig operator's attention, which permits the operator to concentrate on the hoisting operation.

Still another object of the present invention is to provide an automated oil well servicing rig that allows a floor man to handle pipes and rods by a remote control unit mounted around the floor man's waist.

Still another object of the present invention is to provide an automated oil well rigging system that includes a robotic racking system remotely operated by the floor man.

Yet another object of the present invention is to provide an automated oil well servicing rig that automatically makes and breaks rod and tube connections reducing the possibility of accidents.

Yet another object of the present invention is to provide an automated oil well servicing rig that includes a robotic racking machine on a platform that automatically racks pipes and rods on the racking board.

BRIEF DESCRIPTION OF THE INVENTION

The purpose of the present invention is to provide an automated oil well servicing rig (i.e., "Auto-rig") that can be operated safely and efficiently by only two personnel by automating the making and breaking of rod and tubing (generally referred to as "tubulars" in the industry) connections and remotely controlling a robot that racks tubulars on a racking board. The present invention provides an automated oil well servicing rig system in which tongs, for making and breaking tubulars and a racking system, are automatically controlled.

The system disclosed and described herein is similar in operation and function to the system disclosed and described in U.S. Pat. No. 4,591,006 referred to hereinabove, and incorporated herein by reference. That is, the system is fully transportable and automatic to be transported from operation to operation. It is an automatic rigging device that can automatically handle well elements with only two operators. The rig operator controls the slips, tongs and hoisting mechanism while a floor man controls the racking of tubulars, rods or pipes by a remote control device tied to his waist.

The present system is comprised of an automated well servicing system that is transportable from site-to-site for servicing of oil wells. The system is comprised of a vehicle having a cab and a bed for mounting equipment to operate the oil well servicing system. The system includes a derrick that is hydraulically controlled. The control and operating system, mounted on the vehicle, are substantially the same as those shown and described in U.S. Pat. No. 4,591,006 referred to hereinabove and incorporated herein by reference. The transportable rig includes equipment to store and elevate a derrick, automated tong assemblies and a racking board for servicing an oil well.

The system involves the conversion of existing transportable oil well servicing with several unique modifications. The conversion involves the addition of a speed kit including a hoist and elevator modification, unique tong assemblies, a racking board for pipes and rods, and a robotic handler for tubulars with the tong-slip package mounted at the front of the "Auto-rig."

The operation of the device is similar to that previously achieved, with the rig operator operating the hoisting operation as well as the slips and tongs for making and breaking pipes and rods. The power tongs are automated and require a minimum of the rig operator's attention, which allows the operator to concentrate on the hoisting operation.

When pipes or rods are being removed or replaced, a floor man handles the pipes and rods (i.e., tubulars) with a remote controlled robot located on the racking board. The rods and pipes are racked in a configuration similar to that previously used. The robotic rod handler is remotely controlled by a joy stick, on a belt worn around the floor man's waist. The floor man manipulates the robotic rod handler with one hand on the joy stick, leaving the other hand free to guide the tube or rod.

In operation, the system for servicing a rig to remove a string of rods or pipes begins by hoisting a production string out of the hole with the slip set and the tubular collar at a specific elevation for the tongs to break the joint. The robotic rod handler reaches between the hoist lines, after the blocks have been lowered, to guide the top end of a pipe or rod and at the same time, the rig operator activates the power tongs. The tongs automatically make or break a joint and retract. The hoist and elevator are then lowered below the collar of the tubular. The floor man operates the robotic rod handler with a remote control to grip the pipe or rod (i.e., tubular) and lift it out of the collar and rack it into the racking board. As soon as the remotely controlled robotic rod handler is clear of the blocks, the next joint is hoisted up into position to repeat the cycle. The sequence is reversed to return tubulars to the well.

The above and other novel features of the invention will be more fully understood from the following detailed description and the accompanying drawings, in which:

DETAILED DESCRIPTION OF THE INVENTION

Figure 1:
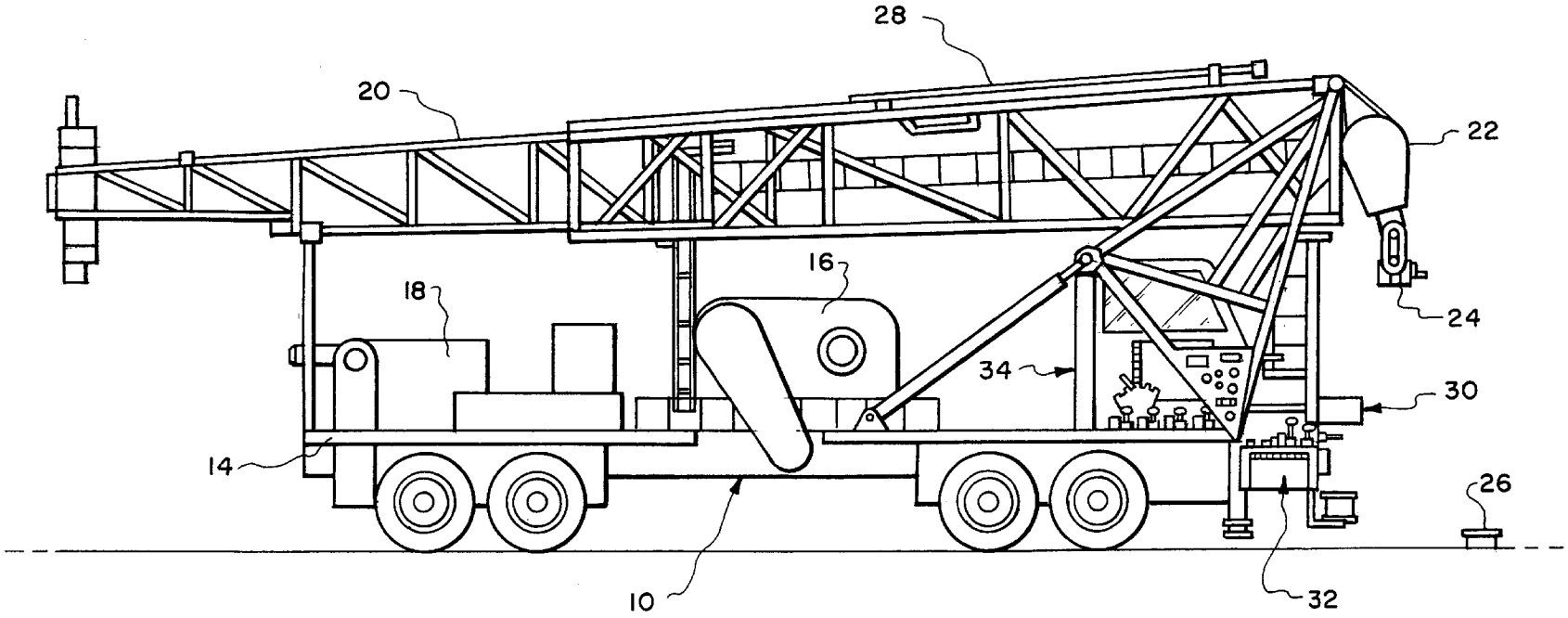
FIG. 1 is a side elevation of a mobile, automatically operated well servicing rig constructed according to the invention.

The mobile well servicing system is illustrated in the side elevation of FIG. 1. The system is similar to that shown and described in U.S. Pat. No. 4,591,006 referred to hereinabove. The system includes a wheeled vehicle 10, having a cab 12 and a bed 14 for mounting operating equipment. The operating equipment includes a winch or hoisting system 16 and a power drive system 18 as described in the patent referred to above. The mobile system includes a hydraulically operated derrick 20, having a hoist block 22 and elevator 24, that are shown in a stored position for transport to a well head 26. A racking platform 28 is folded against the side of derrick 20 for transportation.

A unique part of the system is the inclusion of automatically operated tong assemblies 30 which will be described in greater detail hereinafter. Tong assemblies 30 are pivotally mounted on the frame of derrick 20, and when not in use, are folded against the forward end of vehicle 10. A computer control system 32 is provided for controlling operation of the rod and tube handling tong assemblies 30.

The mobile well servicing system is first driven to a site and positioned adjacent to a well head 26 as illustrated in FIG. 1. Derrick 20 is then raised into a vertical position by hydraulic cylinders 34 and stabilized in the position illustrated in FIG. 2. Racking platform 28 is then lowered to the position shown in FIG. 2 for receiving and racking pipes and rod (i.e., tubulars).

Figure 2:
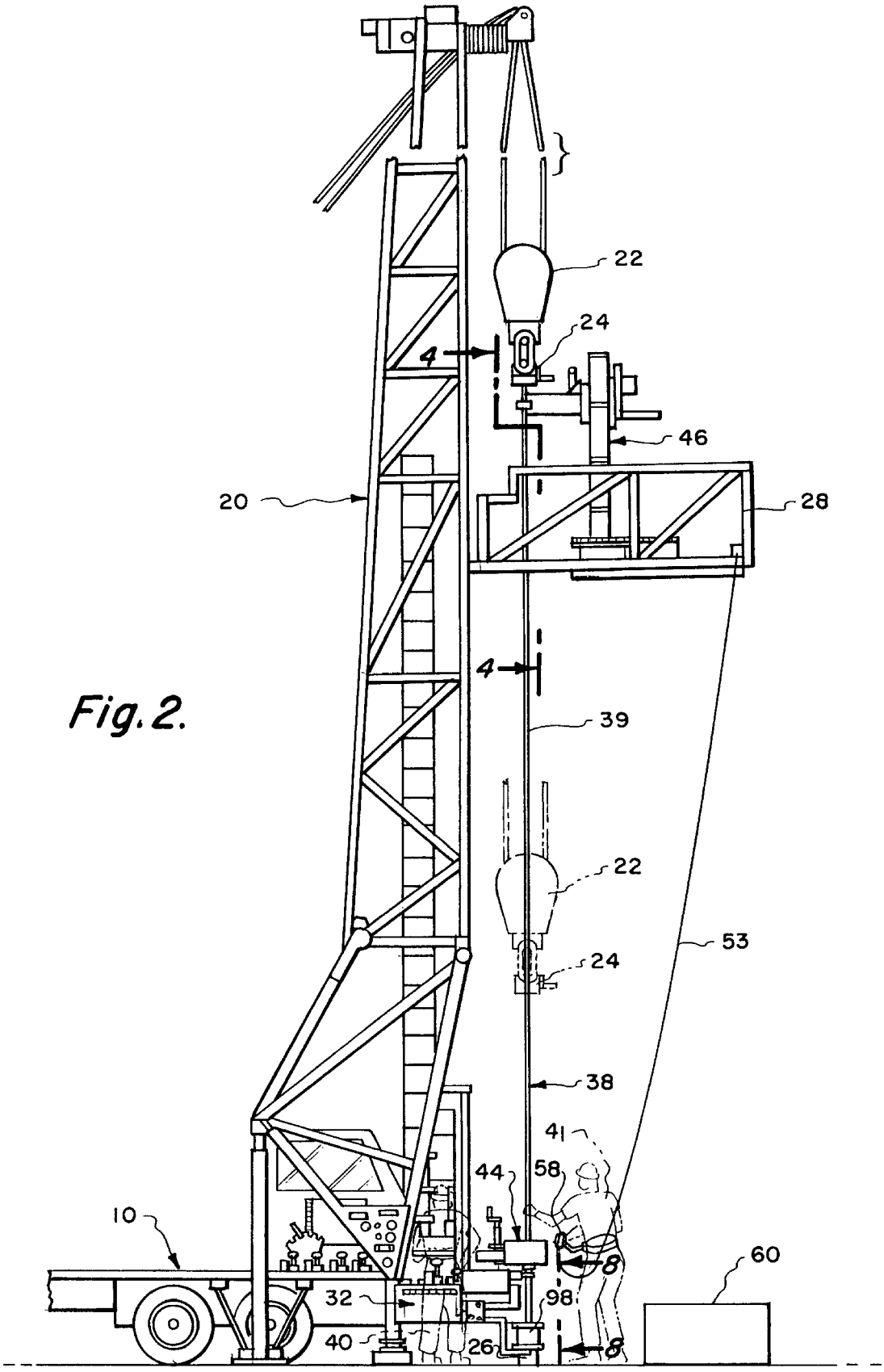
FIG. 2 is a partial sectional side elevation view of the mobile, automatically operated well servicing rig set in an operating position for removing or replacing tubulars.

The system, shown in FIG. 2, is set up for first handling rods. A rod string is first set in position in unique rod slips 98 to hold a rod string 38. Rod slips 98 prevent the string from falling back into the well. Hoist 22 and elevator 24 are then lowered close to rod slips 98 and the collar of rod string 38 placed in elevator 24. Hoist 22 is then lifted to the position shown in FIG. 2. Operator 40 then presses a momentary switch on computer control system 32 to activate tong assembly 44. Once activated, tong assembly 44 moves forward to grip the junction between adjacent rods in rod string 38, automatically disconnects or connects adjacent rods, and then retracts as will be described in greater detail hereinafter.

Figure 3:
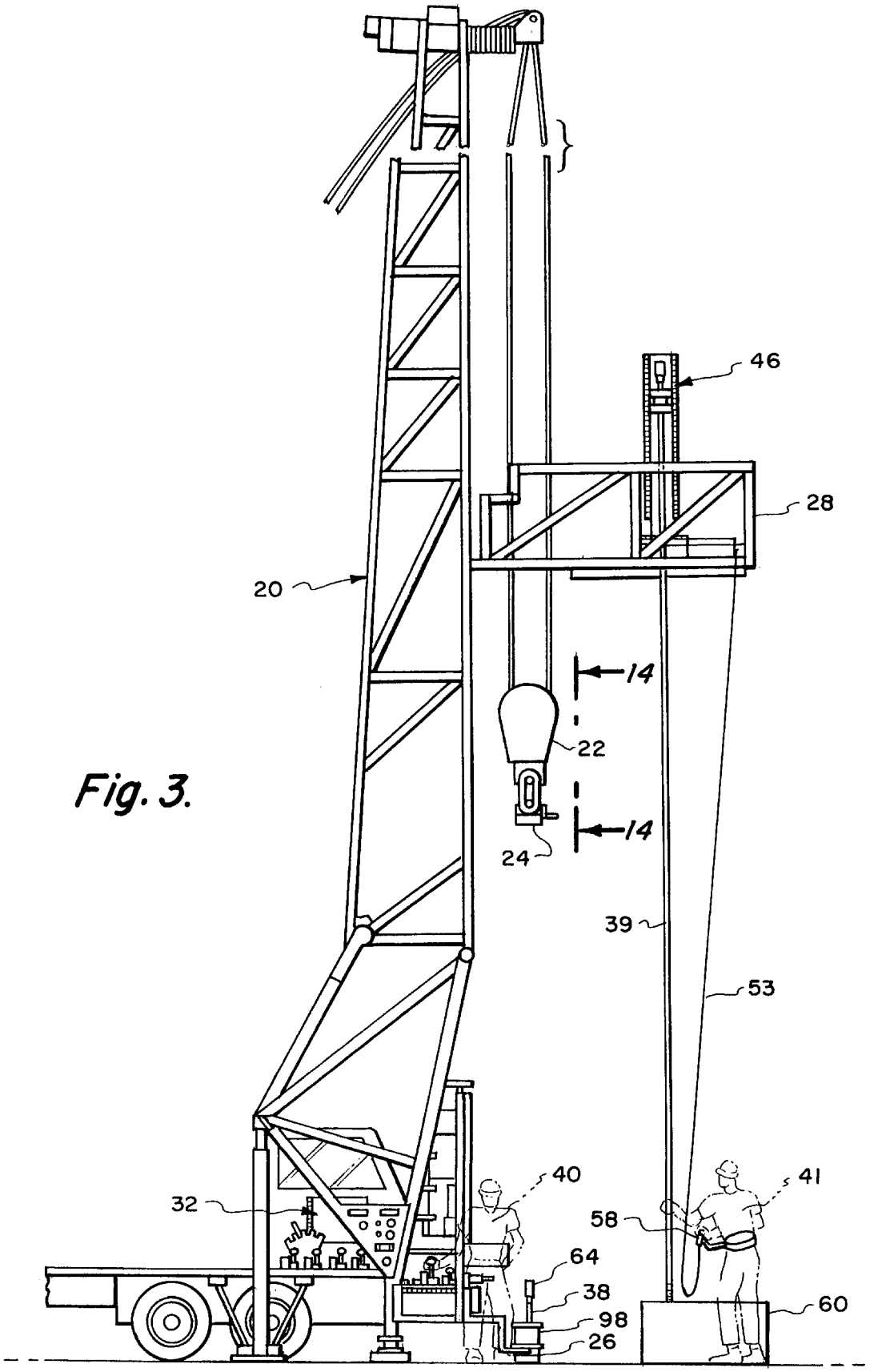
FIG. 3 is a partial sectional side elevation of a mobile, automatically operated well servicing rig set at an operating position illustrating the robotic racking of tubulars.
Figure 7:
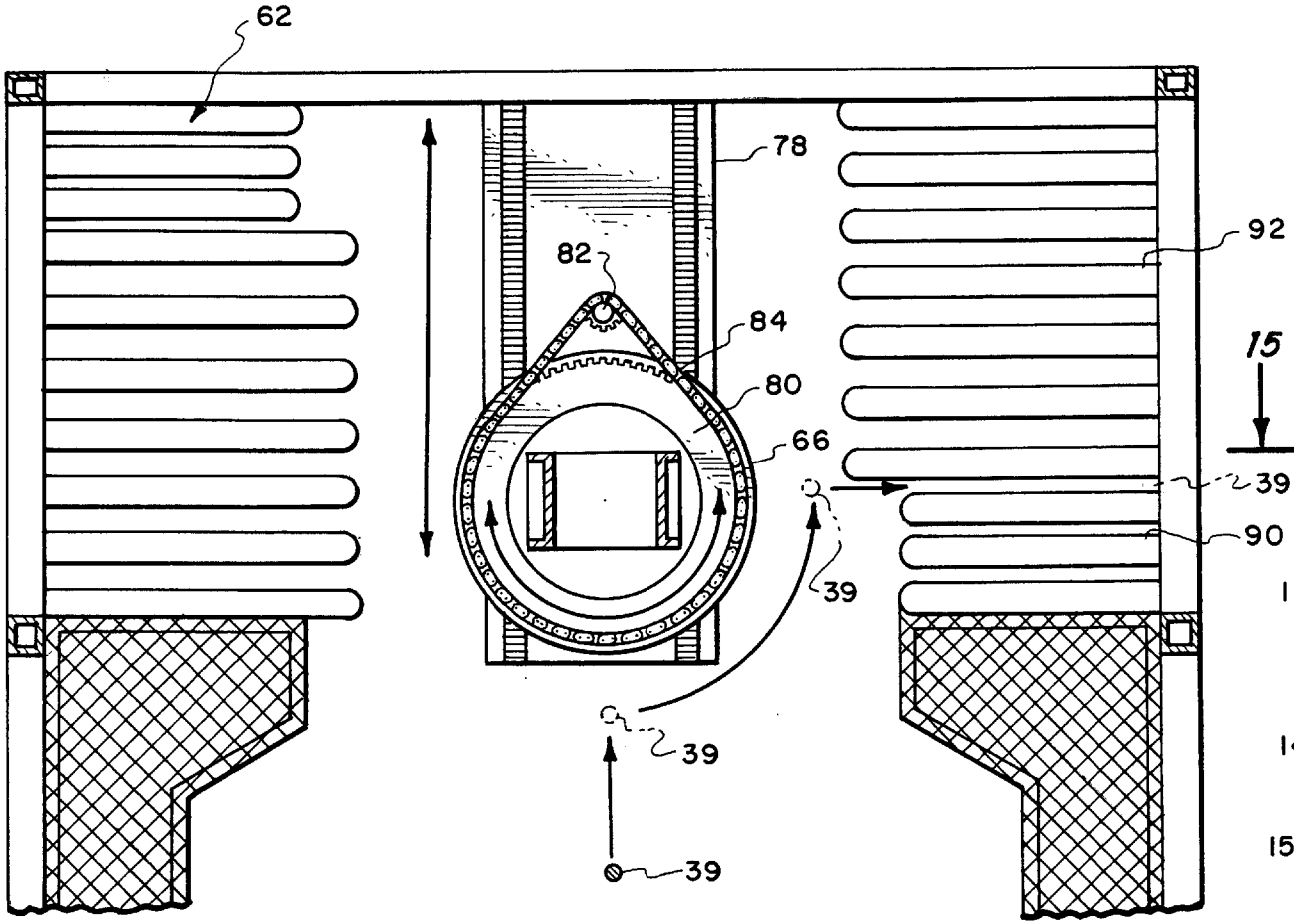
FIG. 7 is a top view taken at 7—7 of FIG. 4 illustrating motion of the robotic rod and pipe handler for racking rods and pipes.

Once an upper rod 39 is detached from rod string 38. The elevator and blocks are lowered and floor man 41 can manipulate robotic rod and pipe handler 46 by a waist mounted control or joy stick 58 connected by cable 53. Floor man 41 advances robotic rod and pipe handler 46 and grips detached rod 39 after hoist 22 has been lowered below racking board 28. Hoist block 22 may now be lowered below the free end of rod 39 allowing floor man 41 to manipulate robotic rod and pipe handler 46 to place the rod in racking board 28 as shown in FIG. 3. The free end of rod 39 is allowed to rest on base 60, supporting the pump horse head (not shown) with the upper end securely positioned in racking board 62 (FIG. 7).

Hoist block 22 may then be lowered to engage collar 64 of tubular string 38 to lift another section of rod for removal. Hoist 22 is lowered until coupling 64 passes through elevator 24. Hoist block 22 may now lift tubular string 38. Slips 98 are constructed to prevent release of tubular string 38 until it is firmly gripped in elevator 24 of hoist block 22.

The remote controlled robotic rod handling system is illustrated in FIGS. 4 through 7. Robotic rod handling system 46 is mounted on racking board platform 28 for movement to rack tubulars in slots in racking board 62. Remote control rod handler 46 is comprised of a base 66 mounted on platform support 68, mast 70, rod handling arm 72 and clamping hand 74. Base 66 has pinion gears 76 that engage rack gear 78 for movement forward and backward on support 68. Mast 70 is mounted on base 66 for rotation by circular gear 80, driven by drive gear 82 and chain 84.

Arm 72 is raised and lowered by pinion gears 86 on opposite sides engaging rack gear 88. Arm 72 and hand 74 are mounted and hydraulically operated to extend and clamp onto tubular 39. A hydraulic safety mechanism is provided to prevent hand 74 from opening until the lower end of a tubular 39 is supported on base 60, as shown in FIG. 3. This prevents tubulars from accidentally being dropped on the floor man's feet.

Figure 6:
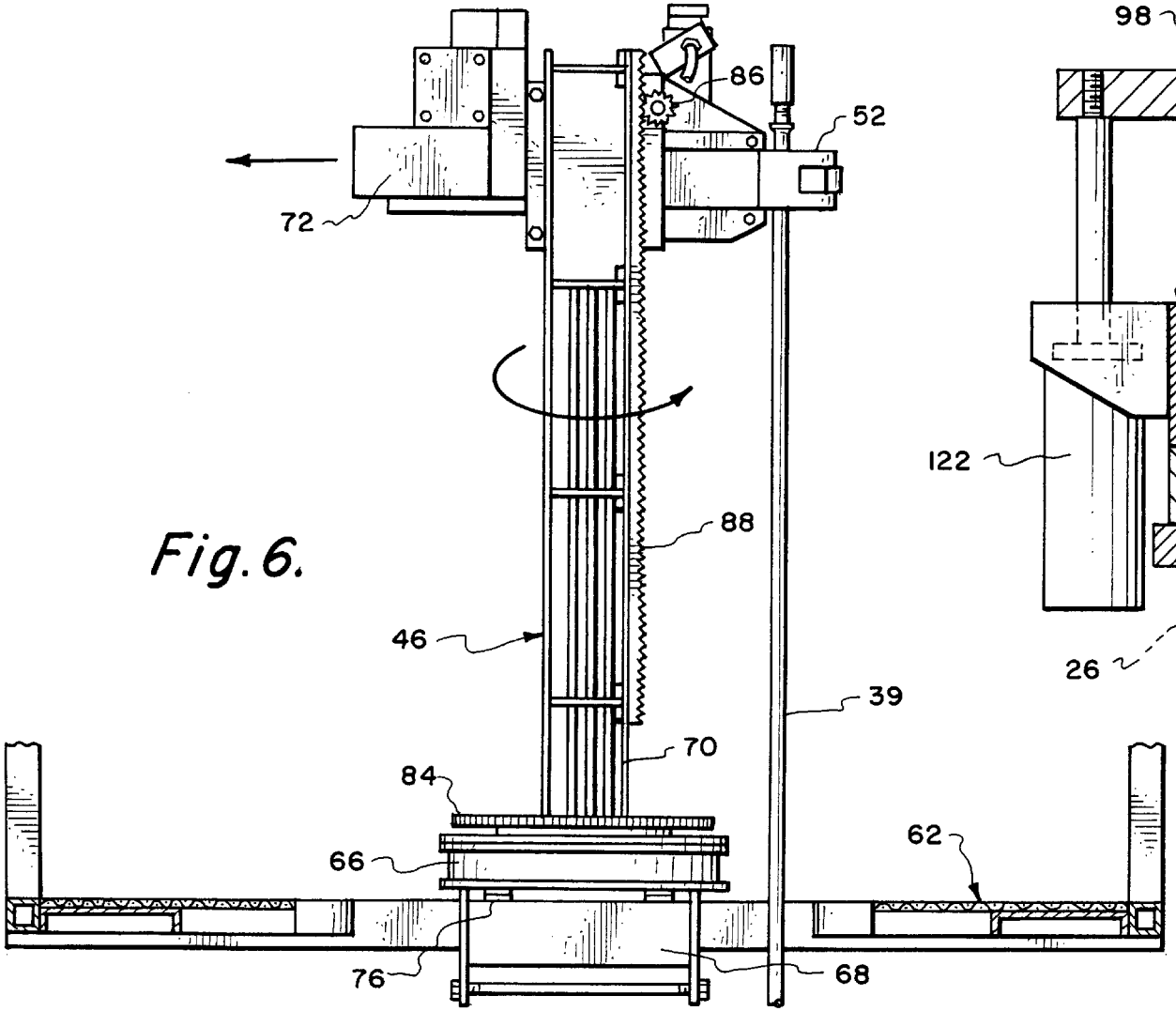
FIG. 6 is another side elevation of the robotic rod and pipe handler illustrating rotation.

To grip tubular 39, robotic rod handler 46 is moved forward to the end of support base 38. Arm 72 is extended, and hand 74, having two fingers 73 on one side and a single center finger 75 on the other, close to the clamp around tubular 39. Hoist 22 and elevator 24 may now be lowered until they are free of the lower end of tubular 39. Arm 72, with hand 52 firmly clamped around tubular 39, is retracted and mast 70 rotated as illustrated in FIG. 6 by operation of joy stick 58 by floor man 41. When arm 72 and hand 74 are rotated so that tubular 39 is in the position shown in FIG. 7, arm 72 is then extended to place tubular 39 in rod slot 90 in racking board 62. When the lower end of tubular 39 is resting on base 60, floor man 41 may release hand 74. However, hand 74 will not release until the weight of tubular 39 is supported as a safety feature to prevent dropping of tubulars on the floor man's feet.

Thus, robotic rod and tube handler 46 allows a floor man 41 to pick up, manipulate and place rods and tubes in rod slots 90 and tube slots 92 in racking board 62. Joy stick 58 is a Model No. M215-21-5-42-06 manufactured by P-Q controls Inc. of Bristol, Conn. that has controls for moving robotic rod handler 46 forward and backward, rotating mast 70, extending or retracting arm 72 and opening or closing hand 52. Remote controlled robotic rod handler 46 eliminates the need for a third man on racking board 62 to rack rods and pipes in rod slots 90 and tube slots 92 reducing operating costs. This system also reduces the potential for accidents that can occur from the precarious position of personnel having to work on the racking platform.

The unique, automatically operated tong assemblies are illustrated in FIGS. 8 through 13, 16, 17 and FIGS. 23*a* through 23*d*. There are two sets of tong assemblies. A rod tong assembly illustrated in FIGS. 8 through 13 and tube or pipe tong assembly illustrated in FIGS. 16 and 17. The mounting system for operation of the tong assembly system is essentially the same, with the slips and backup clamps being slightly different.

Rod tong assembly 92 is comprised of power driven rod tongs 94, rod backup clamps 96 and rod slips 98. Rod slips 98 are unique in construction and prevent the string 38 from dropping back into the well once it is lifted. Slips 98 will hold rod string 38 in place while a section of rod at coupling 100 is being disconnected or connected. Tong assembly 92 is unique because it is fully automated. Rod tongs 94 are preferably 4½ hydroshift power tongs from Eckels Manufacturing Corporation. Rod tongs 94, slips 98 and backup clamp 96 on tong assembly 92 are automatically advanced, clamped and rotated to disconnect or connect rod 39 and then retracted as will be described hereinafter.

Figures 4, 8, 9, 9A:
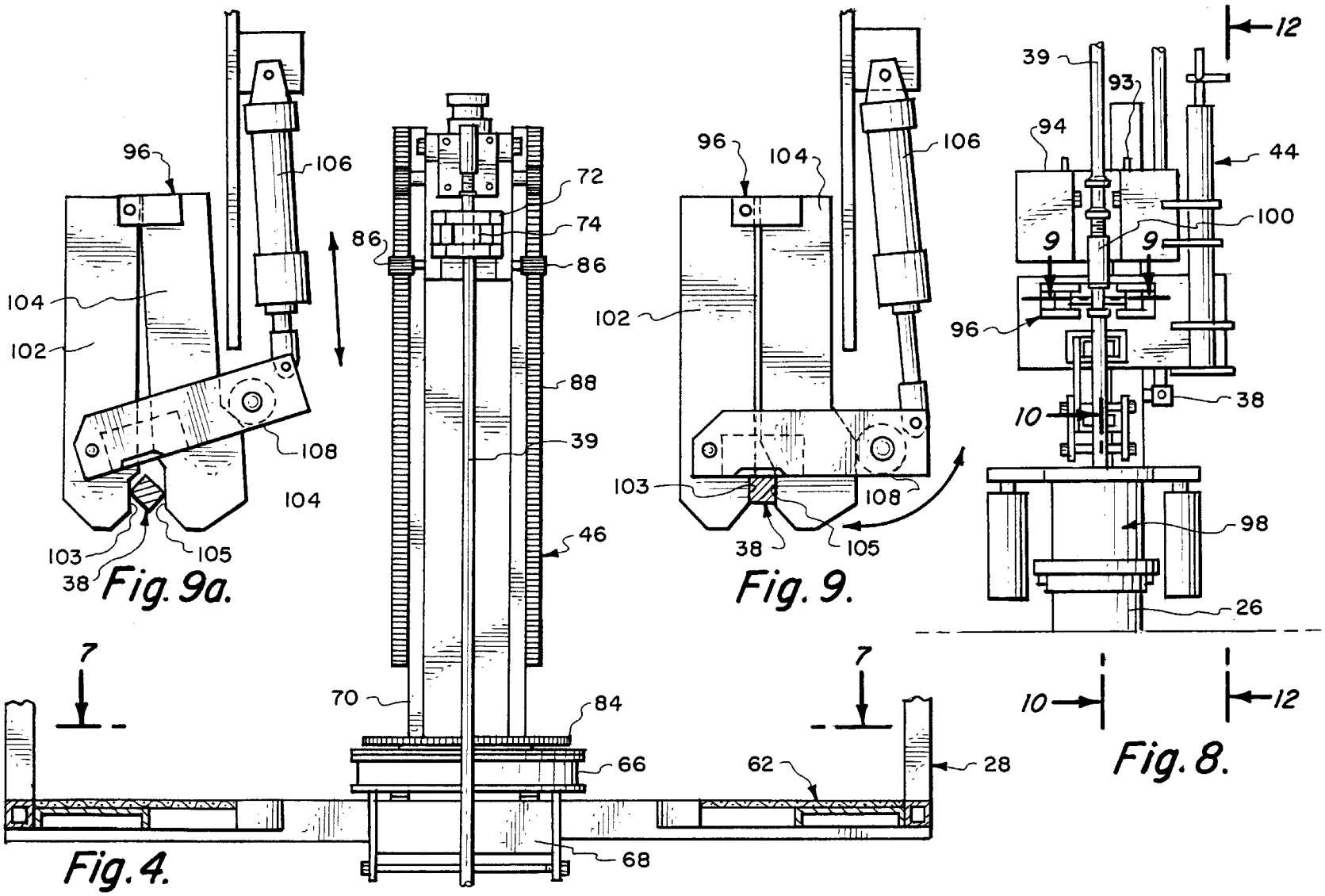
FIG. 4 is a partial sectional view taken at 4—4 of FIG. 2 illustrating the robotic racking system.
FIG. 8 is a partial sectional view illustrating the rod/tong assembly and slips taken at 8—8 of FIG. 2.
FIGS. 9 and 9*a* are partial sectional views taken at 9—9 of FIG. 8 illustrating the construction and operation of the rod backup clamps.

The unique construction and operation of backup clamps 96 are shown in FIGS. 9 and 9*a*. Backup clamps 96 are comprised fixed arm 102 and hinged arm 104 that is closed by operation of air cylinder 106 rotating cam follower 108. When tong assembly 44 is moved forward, flats at coupling 100 of string 38, engage recesses 103 and 105 in arms 102 and 104. The flats on coupling 100 are "found" by actuating air cylinder 102 causing hinged arm 104 to cam up while rotating the rod string up to 100° in the hole. Cam follower 108 allows arms 102 and 104 to open so that flats on rod coupling 100 may "square up" with recesses 103 and 105, as shown in FIG. 9. Once flats in coupling 100 square up with the opening formed by recesses 103 and 105, air cylinder 106 forces cam follower 108 forward closing arm 104 and securely clamping rod string 38. Slips 98, mounted on well head 26, are allowed to rotate by air cylinder 138 while still clamping rod string 38 to allow the string to automatically align in backup clamps 96.

Figure 11:
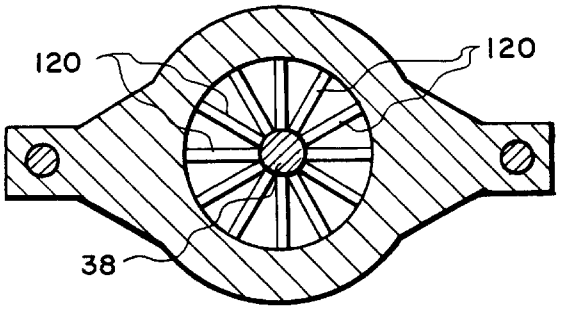
FIG. 11 is a partial sectional view of the rod handling slips taken at 11—11 of FIG. 10.
Figure 10:
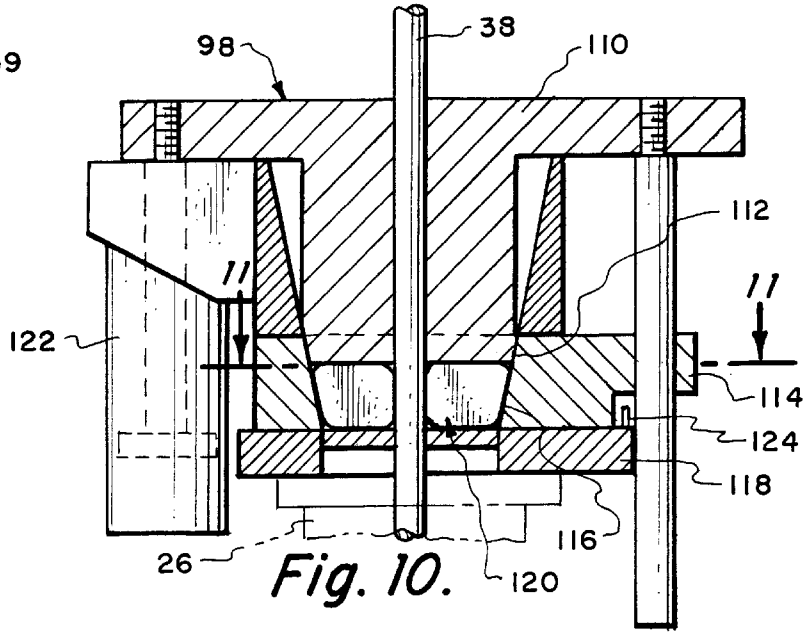
FIG. 10 is a partial sectional view taken at 10—10 of FIG. 8 illustrating the construction and operation of the rod slips.
Figure 5:
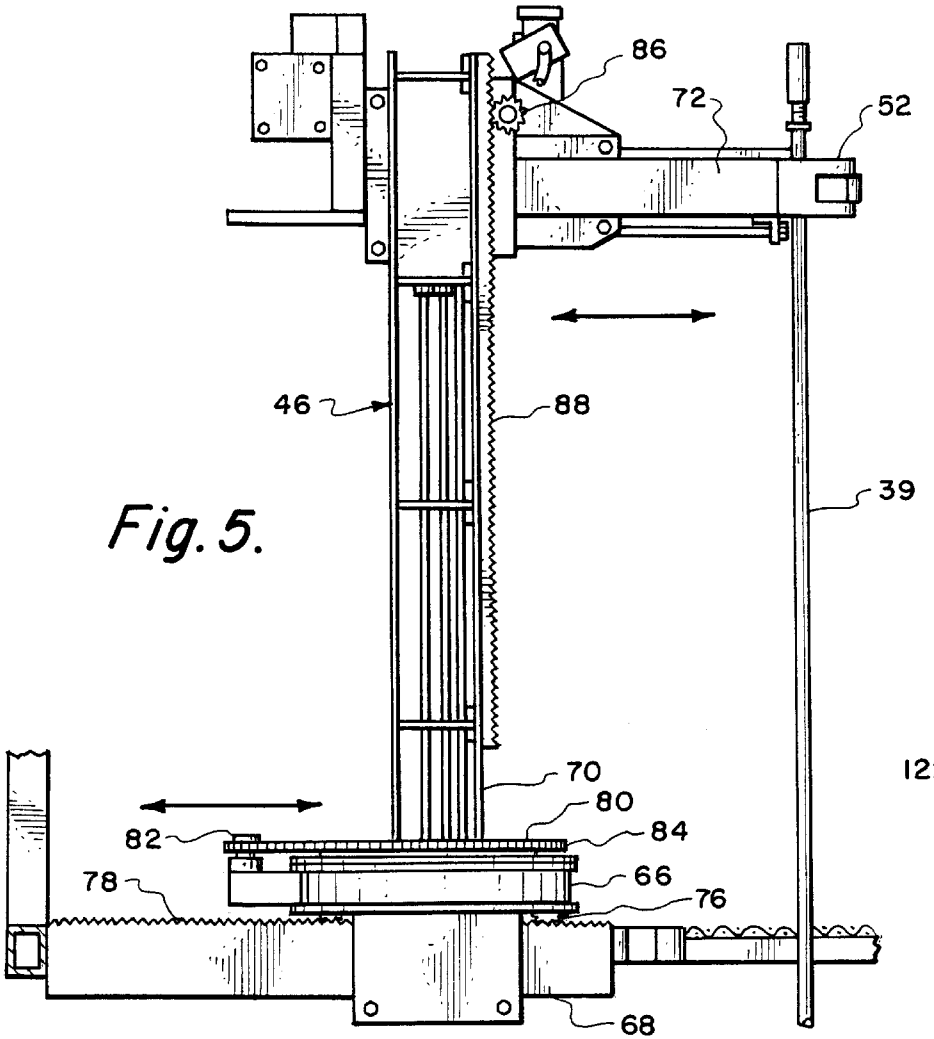
FIG. 5 is a side elevation of the robotic handler for tubes and rods illustrating the movement.
Figure 13:
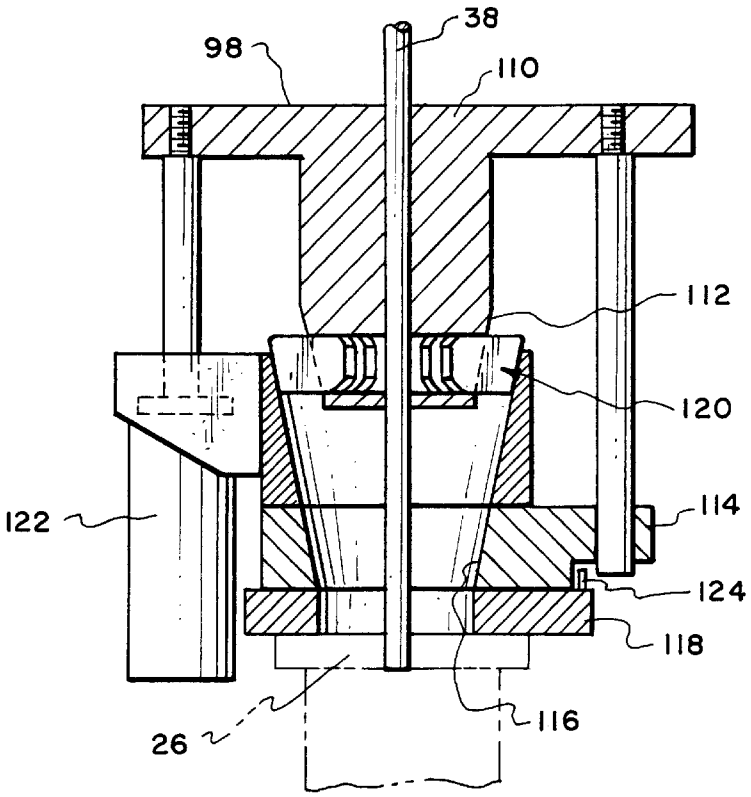
FIG. 13 is a partial sectional view similar to FIG. 10 showing the rod slips in an open position.

Slips 98 are shown in greater detail in FIGS. 10, 11 and 13. Slips 98 are comprised of an upper housing 110, having a conically tapered mandrel 112 and a lower housing 114, having a conically tapered cavity 116. Upper and lower housings 110 and 114 are mounted on base 118 which sits on top of well head 26. Slips 98 clamp tubular 39 by opening or closing pins or slugs 120, fitted in slots in conically tapered mandrel 112 of upper housing 110. Slips 98 are opened and closed by hydraulic cylinders 122 that raises upper housing 110 (FIG. 13) allowing slugs 120 to be released from slots in mandrel 112 to unclamp tubular 39. Proximity switch 124, mounted adjacent slips 98, prevents release of tubular 39 until elevator 24 on hoist 22 has a firm grip on tubular string 38. Thus, upper housing 110 will not separate, as shown in FIG. 13, until elevator 24 has a firm grip on the coupling at the upper end of tubular string 38. This firm grip causes tubular 39 to lift the entire upper and lower housings 110 and 114 of slips 98, activating proximity switch 124 which allows upper housing 110 to separate from lower housing 114, releasing pins or slugs 120. This releases slips 98 allowing string 38 to be hoisted in elevator 24 for removal of the next section.

Slips 98 are unique in that pins or slugs 120 are closed by the action of mandrel 112 being pressed into cavity 116 in lower housing 114 to force pins or slugs 120 inward, as illustrated in FIG. 11. Together, the ends of pins or slugs 120 form a clamping action around string 38, as shown in FIG. 11. The compressing force of slugs 120 allows construction of slips that will securely clamp and hold a rod string without damage to the rod. The system is also secure and prevents accidental release of rod string 38.

Figure 12:
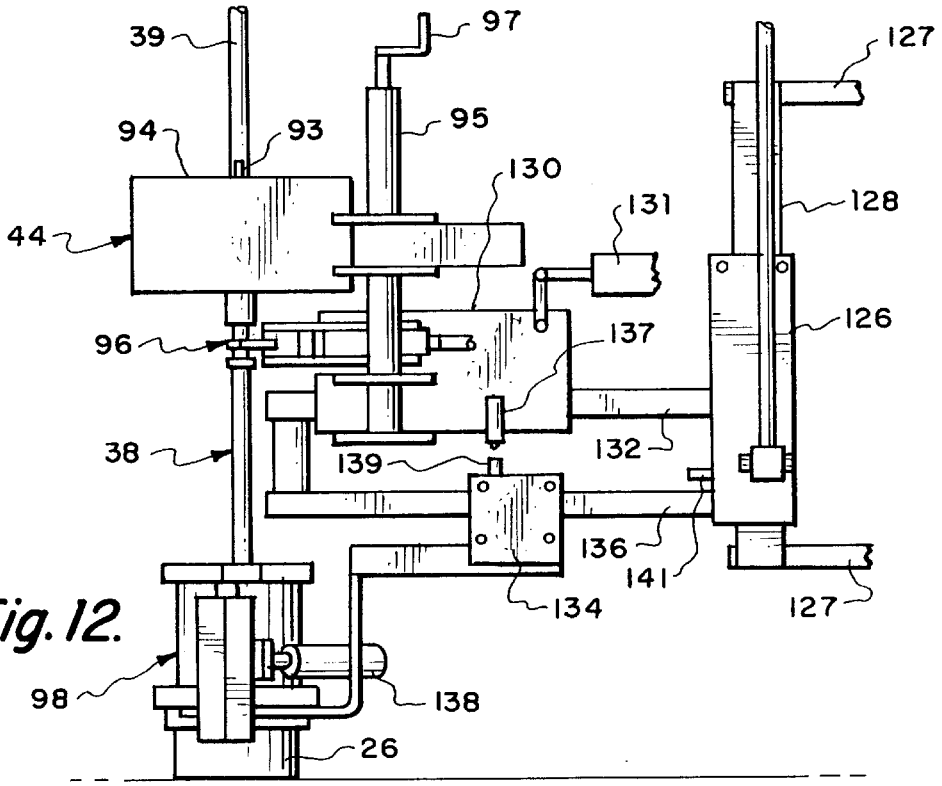
FIG. 12 is a side elevation of the tong and slip handling assembly taken at 12—12 of FIG. 8.

Tong assembly 44 is mounted for automatic positioning and operation on well head 26, as illustrated in FIG. 12. Hillman Kelly 500C Rod Tongs are mounted on a spring loaded cylinder 95 to allow the tongs to move up or down as tubular 39 is disconnected from string 38. This allows some movement up and down during disconnection or connection of a section of the string. Rod 94 may be adjusted upward and downward by rotation of handle 97. Tong assembly 44 and slips 98 are mounted for quick and easy deployment on a frame comprised of cylinder 129, mounted on shaft 128 and attached to supports 127, which are connected to the frame or chassis of derrick 20. This construction allows tong assembly 44 and slips 98 to be pivoted from a position folded away in front of mobile vehicle 10 to a position over well head 26, as will be described in greater detail hereinafter.

Tong assembly 44 is mounted on carrier 130 for movement forward or backward on rail 132. Slips 98 are mounted on carrier 134, mounted on lower rail 136 to move slips 98 forward or backward over well head 26. Preferably, carrier 130 is hydraulically driven by hydraulic cylinder 131 to allow the operator to easily move tong assembly 44 forward or backward. Slips 98 also have air cylinder 138 to rotate slip housing to square up flats of coupling 100 in backup clamps 96, as previously described and illustrated in FIGS. 9 and 9*a*.

The operation of the system is begun by deploying tong assembly 44 and slip assembly 98 by rotating cylinder 126 of shaft 128 away from the front of derrick 20. Slips 98 are then positioned over well head 26 by advancing carriage 134 on rail 136. Tubular string 38 is then securely clamped in slips 98. Proximity switch 137, on carrier 130, detects from metal target 139 on carrier 134 where slips 98 are to control proper positioning of tongs 94 during deployment. The same proximity switch positioning system is also provided on the tube tong assembly. Metal target 141 provides a retract target for tongs 94. The automatic positioning of tongs 94 is important because slips 98 are designed to float on the well head, and their location is not always the same. Tong advancement and operation are then automatically activated by operator 40, as will be described hereinafter.

Figure 14:
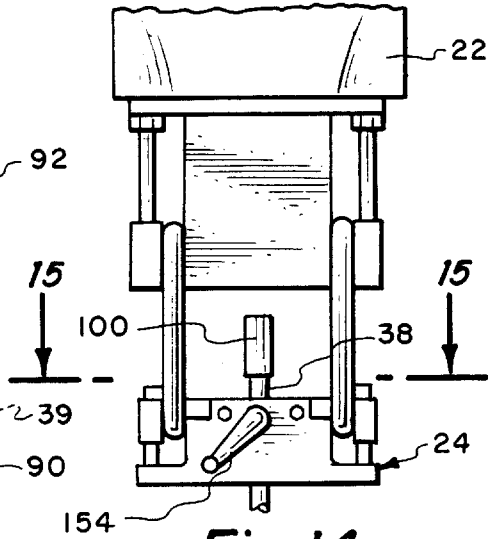
FIG. 14 is a partial sectional view taken at 14—14 of FIG. 3.
Figure 15:
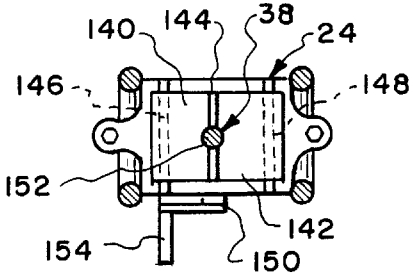
FIG. 15 is a partial sectional view taken at 15—15 of FIG. 14.

The system also employs a unique elevator 24 supported on hoist block 22. Generally, elevator 24 is a solid block of steel or iron that is changed when the system is changed from rods to pipes. With the system shown in FIGS. 14 and 15, this task of removing and replacing an enormous and extremely heavy block of steel is eliminated. Elevator 24, of the present invention, employs a pair of insert plates 140 and 142 fitting a recess 144 in elevator 24. Pins 146 and 148 pivotally support interchangeable plates 140 and 142. Plates 140 and 142 come together at the center 150 of elevator 24 providing aperture 152 to support string 38. By interchanging plates 140 and 142, the size of aperture 152 can be quickly and easily changed. Handle 154 allows plates 140 or 142 to be easily lifted for manually removing string 38 from elevator 24. To connect elevator 24 to the end of a string, hoist 22 is lowered until the end of string 38 pushes plates 140 and 142 up. When coupling 100, on string 38 passes through hole or aperture 152, plates 140 and 142 will drop back down to securely grip string 38. Coupling 100 will now not pass down through aperture 152 because aperture 152 has a diameter approximately equal to the smaller diameter of string 38, below coupling 100.

Figure 17:
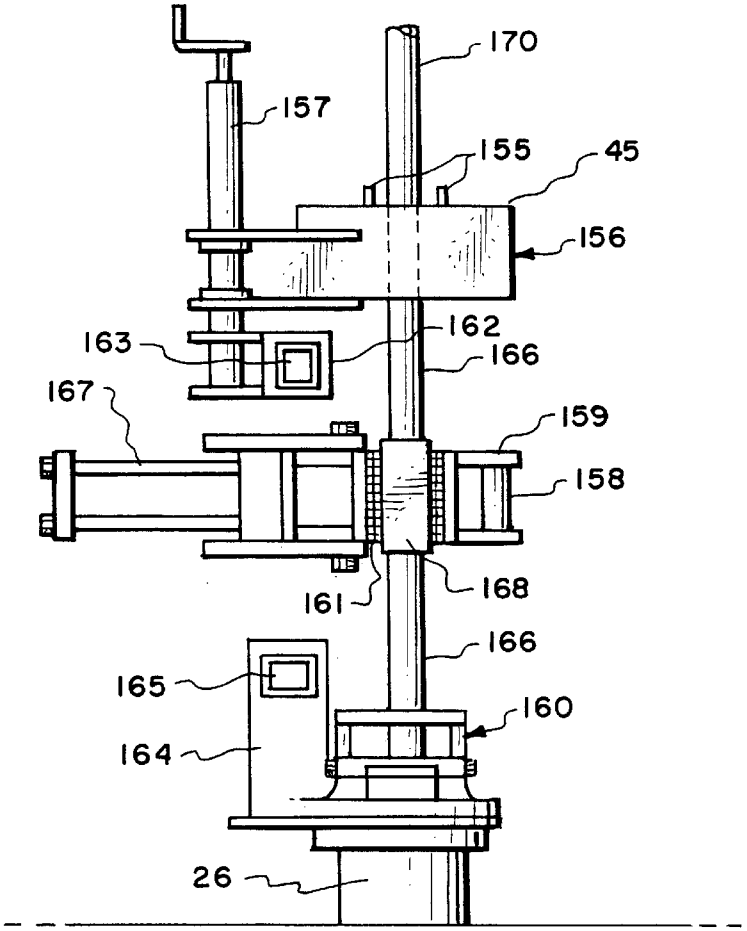
FIG. 17 is a partial sectional view taken at 17—17 of FIG. 16.
Figure 16:
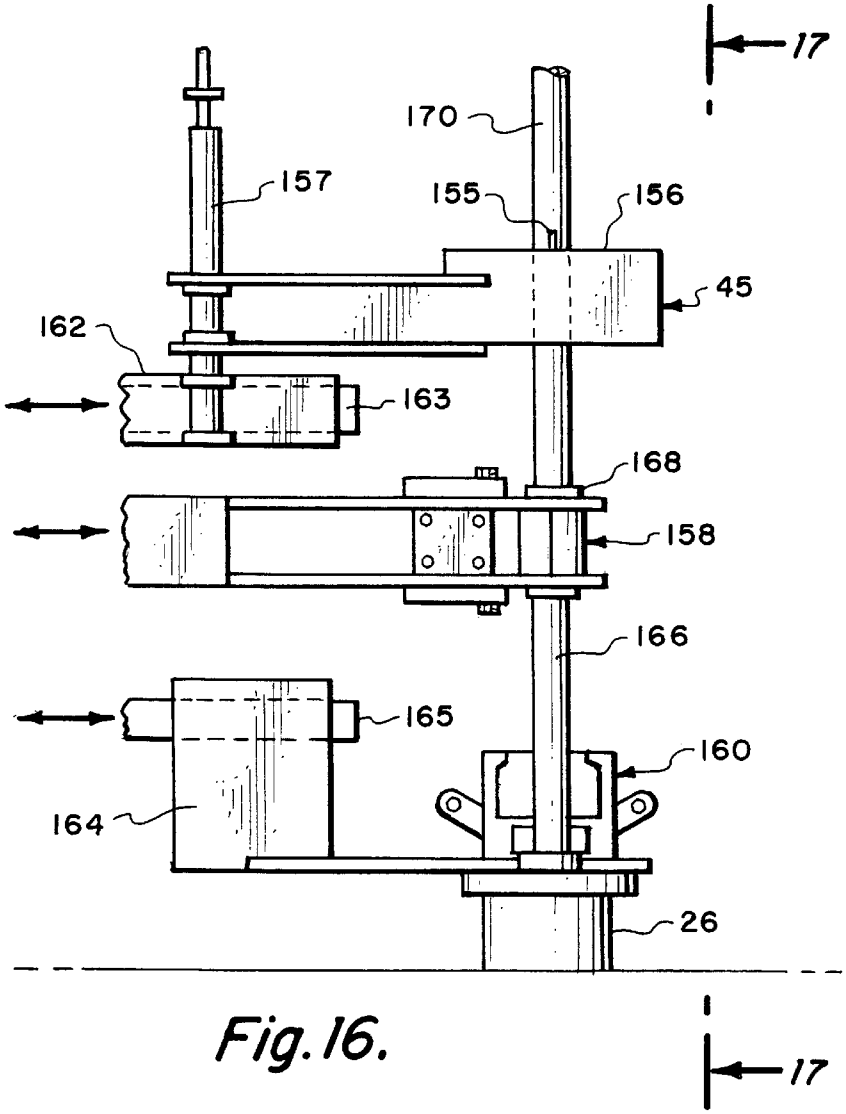
FIG. 16 is a partial sectional view similar to FIG. 12 illustrating the pipe, tong and slip assembly.

Tube tong assembly 45 is illustrated in FIGS. 16 and 17. Tube tong assembly 45 is comprised of power driven Eckels Tongs 156, tube backup clamps 158 and standard Covius Model B tube slips 160. Power tong assembly 45 and tube slips 160 are mounted on carriages 162 and 164 in the same manner as the rod tong assembly 44, illustrated in FIG. 12. Carrier 162 is mounted on rail 163 while slip carrier 164 is mounted on rail 165. Rails 163 and 165 are pivotally mounted on a cylinder similar to the rod tong assembly 44, as illustrated in FIG. 12. This allows each tong assembly to be folded back against the frame of derrick 20 during transportation.

Tube tong assembly 45 and tube slips 160 are deployed by hydraulically moving carriage supporting carriers 162 and 164 forward or backward in the same manner as described hereinabove with respect to the rod tongs. In operation, tube string 168 is extended up through well head 26 and standard tube slips 160, which temporarily hold them in place to prevent them from dropping back into the well. Tube string is then hoisted in elevator 24 until the first coupling passes beyond tube slips 160. Tube tong assembly 45 is then activated by operator 40 to advance power tongs 156 and backup clamps 158 around coupling 168 of tube string 166 and disconnect section 170 by automatically rotating the section 170 a predetermined number of times, as determined by computer control 32 mounted on vehicle 10. Computer control 32 is an Allen Bradley SLC 500 Programmable Logic Computer or its equivalent. Computer controller 32 controls rotation of power tongs 156 a preselected number of times to separate the upper section of tube string 166 at coupling 168. Power tongs 156 float on mount 157, allowing them to rise with (or fall) with section 170 being connected (or disconnected) until the operation is complete. Power tongs 156 and backup clamps 158 then automatically release coupling 168 and tube section 170, and retract by moving carrier 162 backward on rail 163. This allows floor man 144 to rack tube in slots 92 in racking 62, as previously described. Hoist 22 and elevator 24 are then lowered to grasp collar 168 to lift string 166 to the next coupling and is positioned above slips 160.

Figure 18:
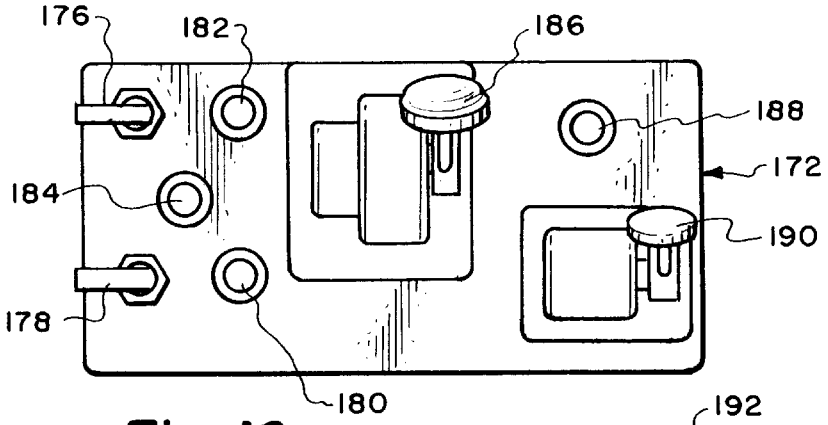
FIG. 18 is a view illustrating the controls for operating the tong assemblies and the hoist.

The automatic operation of tong assemblies 44 and 45 is controlled by computer 32 and control panel 172 (illustrated in FIG. 18) or manually by controls on manual override control panel 198. Control panel 172 has rotary switches 176 and 178 to control the operation of rod tong assembly 44 or tube tong assembly 45 and whether a disconnection or connection is being made. Switch 176 is rotated to a first position to select the rod tong assembly 44 or the tube tong assembly 45. Switch 178 is then rotated to indicate whether a disconnection or connection (i.e., make/break) is being made. Switch 180 automatically starts operation of the selected tong assembly, while switch 182 stops the operation if any problems occur. Pushbutton switch 184 is a switch to instantly interrupt operation of tongs and retract them to a home position.

Throttle and clutch control 186 controls operation of hoist 22 and elevator 24 to lift a string. Pushbutton switch 188 activates rod clamping slips 38 while lever 190 provides control of standard tube slips 160.

Manual override control panel 198 has an omega relay meter 192 to set the make-up torque for the rod and tube tong assemblies 44 and 45. The switches, to the right of the relay meter 192, allow manual override and control of the functions of the rod and tube tongs. Switches 194 allow manual control of the rod tong assembly 44 to move it forward or backward, and select rotation clockwise or counterclockwise, to disconnect or connect a rod section. Switches 196 allow manual control of tube tong assembly 45. These switches are all toggle switches which allow in and out movement of tong assembly 45, clockwise or counterclockwise rotation of tube tongs 156 and whether it is a make or break connection. Switches 188 provide manual override and control of slips 38. They allow opening or closing of the housing to clamp a tubular string 38 and manually control movement of slips 38 forward or backward. Meters 200 provide indication of hydraulic pressure, tong hydraulic pressure and hoist air.

Tube back-up clamp 158, on tube tong assembly 45, is comprised of a pair of arms 159 forming jaw 161 to clamp on collar 168 of tube string 166. Hydraulic cylinder 167 automatically opens and closes jaws 161 around collar 168 when tube tongs 156 are activated.

As previously described, tong assemblies 44 and 45 are automatically operated by Allen Bradley SLC Programmable Logic Computer 32. With a string 38 positioned in slips 98, operator 40 activates operation of the tong assemblies 44 and 45 selected by momentary pushing switch 180. Preprogrammed computer 32 then advances the selected rod tong assembly 44 or 45 forward into position around tubular string 38. Backup clamps are clamped around the lower section of the string while tongs are clamped around the string above the connection. The selected tongs are then automatically rotated a predetermined number of rotations (or preprogrammed hydraulic pressure or torque) to disconnect (or connect) a section from string 38. For rod string 38, computer controller 32 is set to rotate rod tongs 94 approximately nine times. For tube string 170, computer controller 32 is set to rotate tube or pipe tongs 156 fourteen rotations.

The number of rotations are determined by proximity switches mounted on the tongs. Proximity switch 93 determines the number of clockwise and counterclockwise rotations of rod tongs 94. When rod tongs 94 have rotated the amount preprogrammed in computer controller 32, tongs 94 stop and backup approximately one-third to one-half a turn to an open position. For tube tong assembly 45, proximity switch 155 determines the number of clockwise and counterclockwise rotations (approximately fourteen) until tube section 170 is disconnected from string 166. Tube tongs 156 then stop, rotate backward approximately one-third to one-half a turn until they are in an open position. Tong assembly 44 (or 45) is then retracted to a home position allowing a tube or rod to then be racked by robotic rod or tube handler 46.

Figure 20:
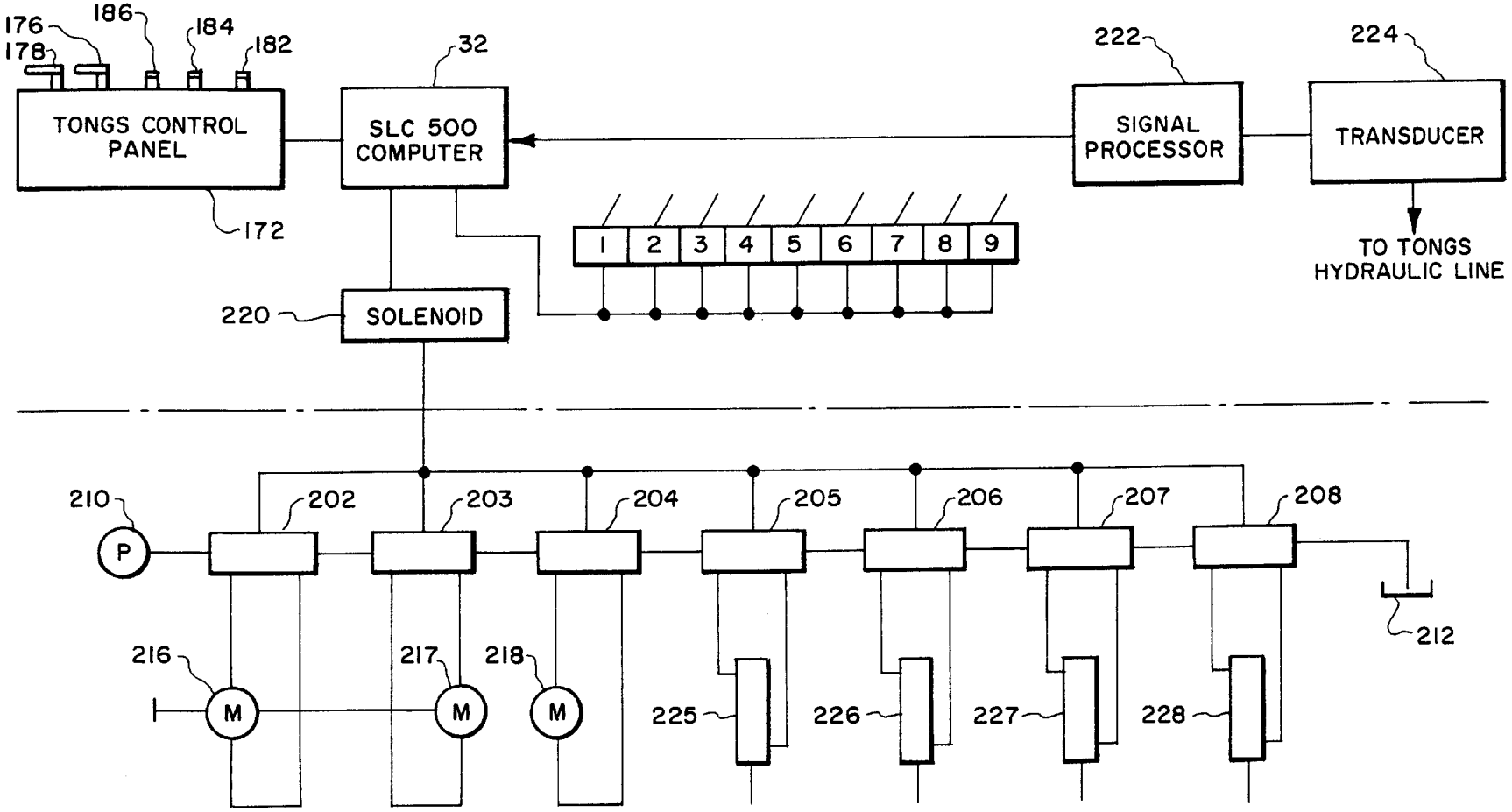
FIG. 20 is a simplified schematic block diagram of the electro-hydraulic system for operating the tong assemblies.

A simplified schematic block diagram of the hydraulic system for operating the rod and tube tong assemblies is illustrated in FIG. 20. In this figure, tong assembly control panel 172 has pushbutton switches to operate the rod or tube tong assembly, pre-selected by a rotary switch. A second rotary switch selects the make (CW), rotation of the tongs or the break for (CCW) rotation of the tongs. Once a rod or tube tong assembly is selected, pushbutton switch starts the automatic operation by deploying the rod tong assembly over the well head and the rod tube string being held in the rod or tube slips. This operation is automatic and under the control of computer 32 which then controls the deployment, the operation of the tongs to make or break a connection and retraction of the tong assembly.

The tong assembly electro-hydraulic control circuit, illustrated in FIG. 20 is comprised of three pushbutton switches 182, 184 and 186 and two rotary select switches 176 and 178. Rotary switch 176 selects either the rod tong assembly or the tube tong assembly. Rotary switch 178 selects make (CW) rotation of the tongs or break (CCW) of the tongs. The pushbutton select switch 182, 184 and 186 respectively provides start, interrupt and stop functions. The start function initiates automatic deployment and operation of the rod or tube tongs under the control of computer 32. When start button 182 is pressed, the operation is automatically controlled by the computer to deploy the rod or tube tongs, position them over the well head and proceed to operate to make or break a rod or tube.

Interrupt switch 184 interrupts the operation under the control of the computer 32 and indexes the tube or rod tong assembly back to its start position. Stop switch 186 stops the system in its tracks if there is a problem with the automatic operation. In this event, manual operation is activated by computer 32, permitting manual operation of the system.

Figure 19:
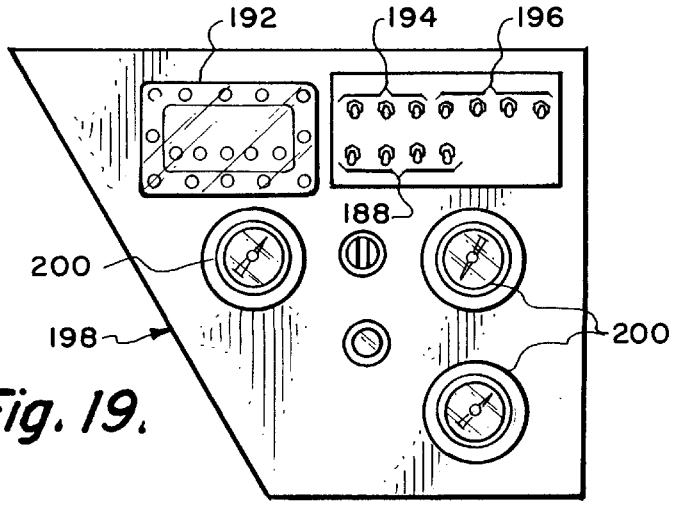
FIG. 19 is a view illustrating a control panel for manually operating the tong assembly and hoist.

Manual override switches labeled 1 through 9 can then be used to control the operation of the tube or rod tongs in any way desired. Switches labeled 1 through 3 are switches 194 on manual override panel 198 illustrated in FIG. 19. Each switch is a toggle switch providing three separate operations. One switch provides for advancement or retraction of the tube tong assembly. The remaining two switches labeled 2 and 3, permit CW or CCW rotation and to select of make or break. Each of these switches is a spring loaded toggle switch with a normal center off position.

The second set of switches labeled 4 through 7 provide manual override and control of the tube tong assembly. Switch 4 provides for advancement or retraction of the tube tong assembly while switch 5 selects open or close function. Switches 6 and 7 select make or break action of the tube tongs in high gear or low gear. Operation of switch 6 alone selects high gear speed while operation of both switches 6 and 7 provide for low gear speed operation of the tube tongs as will be described in greater detail hereinafter.

Omega signal processor 222 is provided to set-up the make-up torque for rods or tubes. Transducer 224 picks up hydraulic pressure from the hydraulic line to the rod or tube tongs and provides an input to omega signal processor 222, which provides an output to computer 32 to set the make-up torque for the rod and tube tong assembly. Signal processor 222 sets the control of the system and provides input to SLC 500 computer 32 according to the signal received from transducer 224 that monitors the hydraulic pressure to the rod and tube tongs. Maximum pressure is used to break a string while the pressure is controlled according to the input from the transducer and the omega processor could control for the make or reconnect function.

Outputs from computer 32, or from manual override switches labeled 1 through 9 control the operation of tube tongs, rod tongs, tube tongs deployment, rod tongs deployment, tube back-up or rod slips. Hydraulic pump 210 continuously pumps hydraulic fluid from reservoir 212 for the operations selected by SLC 500 computer 32 to operate one or more of electrical valves 202 through 208. Electrically operated valves 202 and 203 operate hydraulic motors 216 and 218 to provide two functions for the tube tongs. The system is a split system using dual hydraulic motors for high torque and for low speed operation, and is a single hydraulic motor by selection of a single electrical valve 202 to operate tube tongs at high gear speed. Low gear speed is used to search for the proximity switch on the tube or rod tongs and takes about one turn. Low gear is also used with the tube tongs to help break a joint.

Electrically operated hydraulic valve 204 operates hydraulic motor 218 to drive the rod tongs to make or break a rod string. When rod tongs and make or break functions are selected by rotatory switches 176 and 178, computer 32 sends a signal to valve 204 to operate hydraulic motor 218 when start button 182 is pushed.

Computer 32 also selectively operates electric valves 205 through 208 to operate hydraulic cylinders 225 through 228. Hydraulic cylinder 225 and hydraulic cylinder 226 deploys the tube tongs. Electric valve 206 and hydraulic cylinder 226 deploy the rod tongs. Electric valve 207 and hydraulic cylinder 227 operate the tube back-up clamps to hold a string while a section is being broken or made. Electrical valve 208 operates hydraulic cylinder 228 which operate the rod slips that clamp a rod string while the rod tongs are deployed and are making or breaking a connection.

When the rod or tube tong control system pushbutton switches are operated, they either start the automatic operation of a selected rod or tube tong assembly, stop it or interrupt it during operation. Stop switch 186 stops the entire operation of the selected tong system in its tracks, allowing use of manual override control switches 1 through 9 which control the operation of the rod or tube tong system. Interrupt switch 184 interrupts the operation of the select tong system indexing it back to a neutral or open position, and withdrawing from the string. This positions it for restarting the automatic operation.

Figure 21:
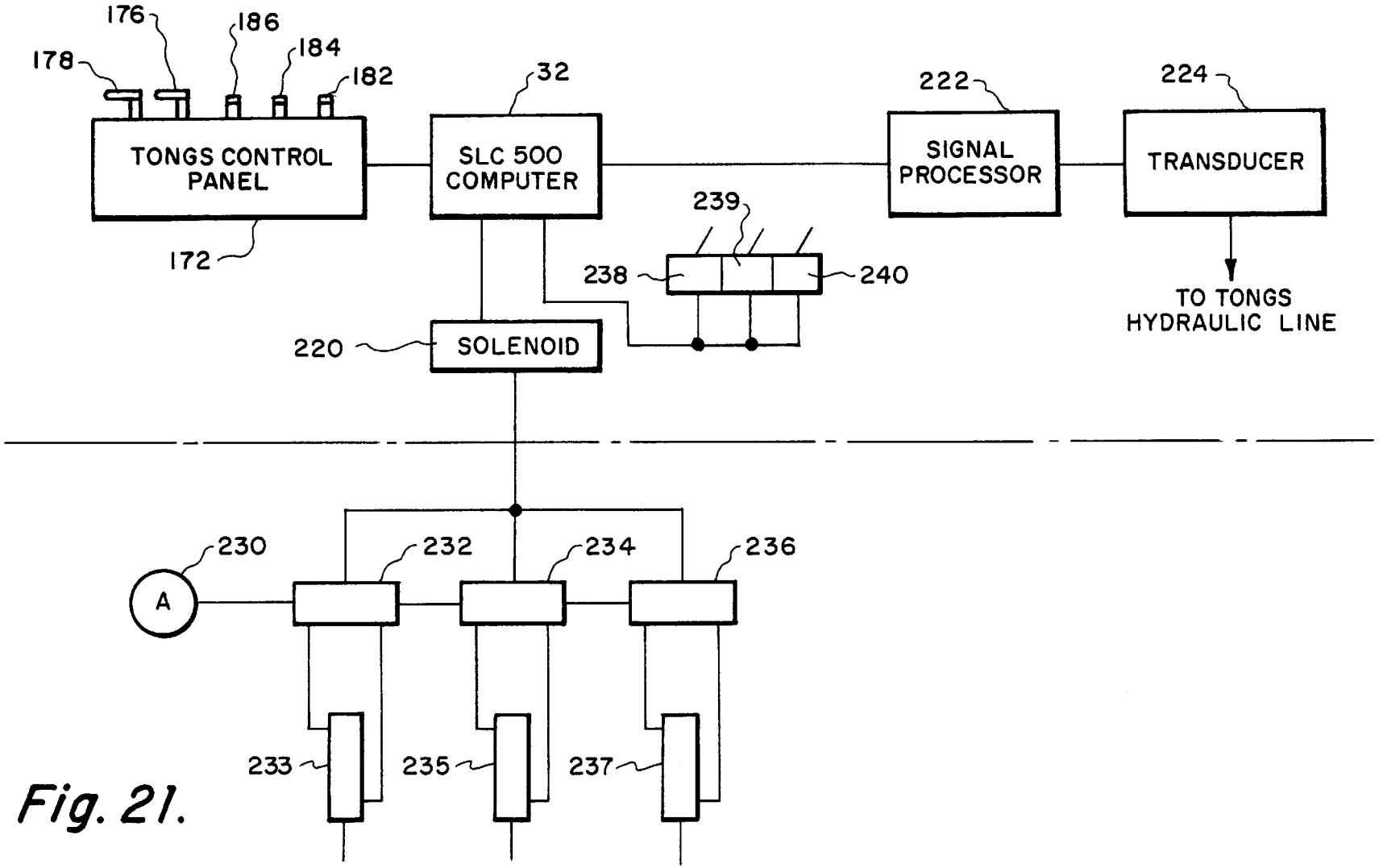
FIG. 21 is a simplified schematic block diagram of the rod tong air circuit for operating the rod tong assembly.

FIG. 21 is a simplified schematic block diagram of the selected tong circuit air operation. This circuit works in conjunction with the rod or tong hydraulic circuit of FIG. 20. Air compressor 230 provides air to electrically operated valves 232, 234 and 236 to operate air cylinders 233, 235 and 237 under the control of elective over air solenoid valve 220 called a "Skimer valve." Electric valve 232 and air cylinder 233 are operated to select a high or low gear operation of the rod tong system when deployed. This system changes the gear shift load to low speed to allow the tube tongs to "look" for the proximity switch on the rod tongs for indexing.

Electrically operated valve 234 and pneumatic cylinder 235 operate the pneumatic cylinder for the rod tong back-up system to open or close it. This allows the rod tong back-up clamps to seek the wrench flaps on a rod coupling. Electric valve 234 and pneumatic cylinder 235 attempt to close the jaw of the back-up clamps on the rod string wrench flats at the coupling. Simultaneously, electric valve 236 and pneumatic rod slip cylinder 237 rotate the rod slips and rod string up to 100° until the wrench flats on the back-up clamps seat in the jaw.

As in the automatic circuit of FIG. 20, this circuit is automatically controlled by SLC 500 computer 32 and switches 182, 184, 186 and rotary switches 176 and 178 on tong control panel 172. When the operation is interrupted by pushbutton stop switch 186, the system allows manual control by toggle switches 238, 239 and 240 to manually control the functions of selection of the gear shift load by electrical valve 232, or the rod back-up clamps by electrical valve 234 or the rod slip rotation by electrical valve 236. Manually operated toggle switch 238 will operate electrical air valve 232 while toggle switches 239 and 234 operate electrical air valves 234 and 236 respectively.

Figure 22:
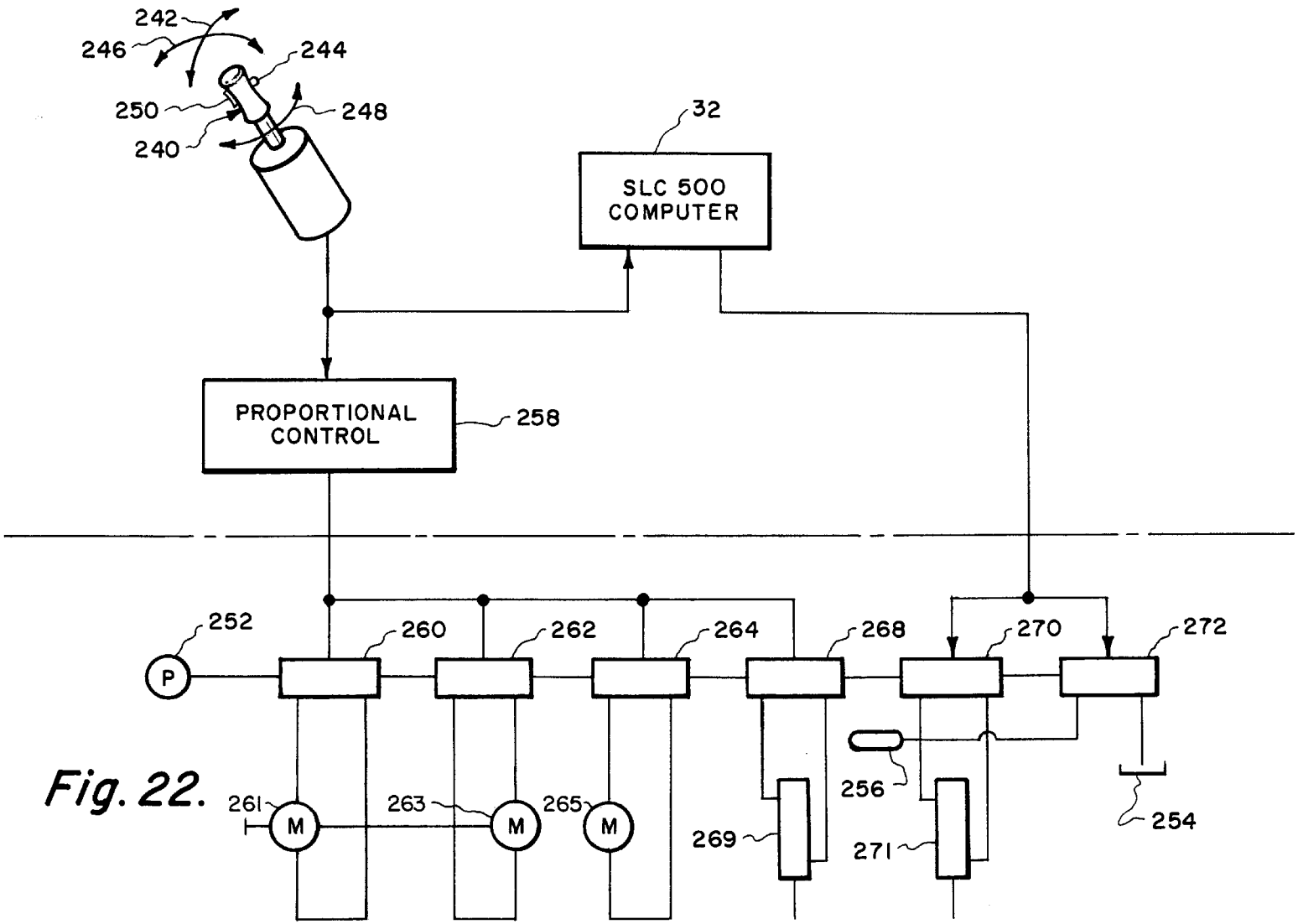
FIG. 22 is a simplified schematic block diagram of the hydraulic circuit for operating the rod and tube racking system.

FIG. 22 is a simplified schematic block diagram illustrating the operation of the rod or tube racking system. This system is comprised of a hand control or "joystick" 240, that controls forward or backward movement of the dolly or carrier for the racking arm and hand, as well as the in and out movement of the arm as indicated by arrow 242. Switching from forward to backward movement of the dolly is achieved by activation of trigger switch 244 on the hand control 240. The side-to-side movement of hand control 240, indicated by arrow 246 controls the vertical travel of the arm in the mast. Rotation of hand control 240, indicated by arrow 248, controls rotational movement of the mast and arm. Trigger 250, on the back of hand control 240, controls the functions of opening, closing or clamping the hand on the arm. Hydraulic fluid is provided to the system by pump 252 from reservoir 254, and includes back-up accumulator 256 that acts like a spring to maintain the hand grip in the event of a leak in the hydraulic system. This is a safety feature to prevent the hand on the racking system from opening should hydraulic fluid leak.

Hand control 240 is connected through proportional control 258 to electrical valves 260, 262, 264 and 268 to control hydraulic motors 261, 263 and 265 and hydraulic cylinder 269. The relative speed of operation of each of the functions controlled by electrical valves 260, 262, 264 and 268 is controlled by proportional control. That is, slow movement of hand control 240 provides slow movement of the respective function of the racking system. For example, electrical valve 260 controls forward and backward movement of the racking dolly or carrier. Slow forward movement of hand control 240 will move the dolly forward or backward slowly. The greater the movement of hand control 240, the faster the dolly will move forward or backward. Electrical valve 262 and hydraulic motor 263 control rotation of the mast and arm. Again, slow rotation indicated by arrow 248, of hand controls 240, slowly rotates the arm while more rapid movement will increase the speed of rotation. Proportional control 258 is a control system produced and manufactured by Vickers, Model No. KD64V32C085MUH60.

Electrical valve 264 controls the vertical travel of the arm up and down by side-to-side movement of hand control 240, as indicated by arrow 246. Electrical valve 268 operates hydraulic cylinder 269 to move the arm in or out. This movement is controlled by forward and backward movement of hand control 240 as indicated by arrow 242, while activating trigger 244. Thus, the forward and backward motion of hand control 240 provides for forward or backward movement of the dolly or forward or backward movement of the arm, as selected by trigger 244.

The operation of the racking hand is controlled by operation of switch 250 on hand control 240 through SLC 500 computer 32 that activates electrical valve 270 or 272 to operate hydraulic cylinder 271 or vent accumulator 256. There are three separate operations of the hand on the racking system controlled by switch 250. The hand is either open or closed, loosely holding a rod or tube string or clamped to tightly grip the rod or tube string. The closed or partially closed position allows the tube rod string to rotate in the hand while the clamp position allows a separate tube or rod to be lifted and brought to or from the racking system.

Figure 23A:
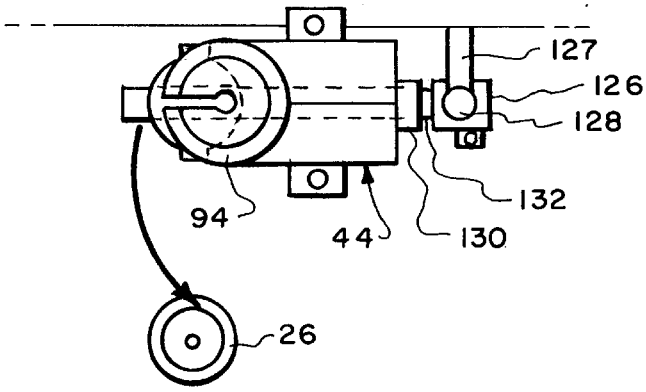
FIGS. 23*a* through 23*d* are drawings in schematic form to illustrate the deployment and automatic operation of the rod and pipe tong assemblies.
Figure 23B:
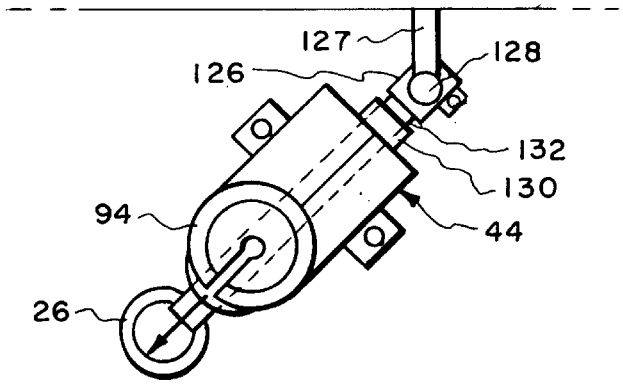
Figure 23C:
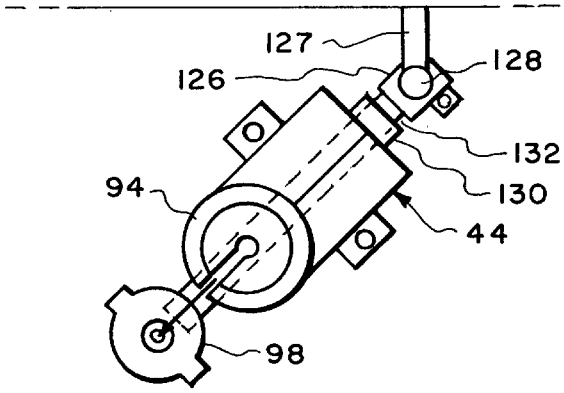
Figure 23D:
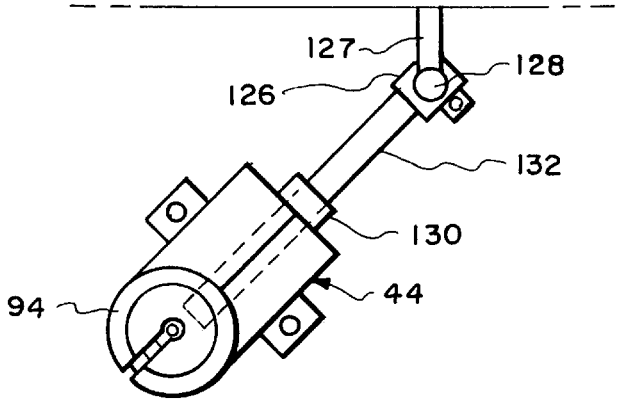

The operation of the tong assemblies is schematically illustrated in FIGS. 23*a* through 23*d* and is the same for the rod or the tube tong assemblies. For purposes of illustration, this operation will be described with respect to the rod tong assembly. Referring now to FIG. 23*a*, rod tong assembly 44 is shown in a folded position against the front of derrick 20 for transportation. Rod tong assembly 44 is swung into a position above well head 26, as shown in FIG. 23*b*. Rod slips 98 are then advanced over well head 26, as illustrated in FIG. 23*c*, by moving carrier 134 forward. This positions rod slips 98 over well head 26. Hoist 22 and elevator 24 then lift the string until a coupling is above slips 98. Slips 98 are then activated to clamp the coupling and operator 40 activates the automated tong assembly by pressing momentary pushbutton switch 180. This automatically advances rod tong assembly 44 into engagement with string 38. Backup clamp 96 then clamps on the flats below coupling of rod string, as shown in FIGS. 9 and 9*a* and powers tongs 94 begin automatically clamping and rotating the section to be disconnected or connected. A rod section is rotated approximately nine times (or approximately fourteen times for tube) until disconnected. Rod tongs 94 then stop and rotate clockwise until tongs are in an open position as illustrated in FIG. 23*d*. The number of rotations are preprogrammed in computer 32. Floor man 41 may now rack the rod (or tube) in the racking board. The operation is then repeated until all rods and tubes are removed from the well. To replace rods or tubes, the procedure is reversed with the rods or tubes being lifted from the racking system and placed over the well. Tong assemblies 44 and 45 are then repeatedly activated as each section is positioned to make the connection.

Thus, there has been disclosed, a unique automated well servicing system that allows complete automation of the making/breaking of rods or tubes and allows remote control racking by a floor man. The system eliminates the need for a third man up in the racking port to place rods into the rack. The system also has safety features because it keeps the operator and the floor man away from the operation of disconnecting or connecting sections of rods or tubes. The making or breaking of rods and tubes is completely automated and computer controlled. The system also includes a unique slip system to securely clamp rods or tubes and a backup clamp system that allows rod flats to square up before beginning the automatic disconnection or connection. In addition, the automated rod and tube tong assemblies are pivotally mounted for storage against the frame of the mobile vehicle when being transported from one well to another.

This invention is not to be limited by the embodiment shown in the drawings and described in the description which is given by way of example and not of limitation, but only in accordance with the scope of the appended claims.

What is claimed is:

1. A mobile oil well servicing system having a derrick and hydraulic system mounted on the chassis of a vehicle the improvement comprising;

automatic tong assembly means pivotally mounted on said derrick for automatically disconnecting and reconnecting tubulars to service an oil well;

automatic deploying means for automatically deploying said tong assembly means into engagement with a tubular string;

remote controlled tubular racking means for racking and unracking tubulars when a well is being serviced;

hoist means for raising and lowering a tubular string during well servicing;

whereby a well may be serviced with minimum handling of servicing equipment by personnel.

2. The system according to claim 1 in which said automatic tong assembly means comprises;

frame means pivotally mounted on said derrick;

tong means mounted on said frame means;

hydraulic moving means for moving tong means into and out of engagement with a tubular string;

said hydraulic moving means including automatic control means for automatically deploying said tong means into engagement with a tubular string, rotating a string section to disconnect or connect said section from the tubular string; and retracting said tong means when the disconnection or connection is complete.

3. The system according to claim 2 in which said tong assembly means includes backup clamps for clamping on said tubular string while said tong means is disconnecting or connecting a tubular section.

4. The system according to claim 3 in which said backup clamps includes a pair of clamping jaws; and hydraulic jaw opening and closing means; said automatic control means automatically closing said backup clamps when said tong means is moved into engagement with said tubular string.

5. The system according to claim 4 in which said backup clamp includes a cam follower; said cam follower controlling closure of said clamping jaws when said tubular string is properly positioned.

6. The system according to claim 2 in which said automatic control means includes detecting means for detecting when said tong means has completed a disconnecting or connecting operation.

7. The system according to claim 6 in which said detecting means comprises a pair of proximity switches mounted in said tong means; said proximity switches counting the number of complete rotations of said tong means; whereby said automatic control means stops said tong means after a predetermined number of rotations.

8. The system according to claim 7 in which said detection means is adapted to count between 8 and 15 rotations.

9. The system according to claim 8 in which said automatic control means automatically backs said tong means up to an open position when a disconnecting or connecting operation is complete.

10. The system according to claim 3 in which said tong means and said backup clamps are mounted on a hydraulically operated carrier for moving said tong assembly into and out of engagement with said tubular string.

11. The system according to claim 10 in which said tong assembly includes slip means mounted on said pivotally mounted frame; and hydraulic slip moving means for moving said slip means into and out of position on a well head around said tubular string.

12. The system according to claim 11 in which said slip means includes lift detecting means for detecting a lifting force by said hoist means; said lift detecting means preventing said slip means from releasing a tubular string until said hoist means has a firm grip on said tubular string.

13. The system according to claim 12 in which said lift detecting means comprises a proximity switch on said slip means for detecting a lifting movement of said slip means when said hoist means has a firm grip on said tubular string.

14. The system according to claim 13 in which said pivotally mounted frame means comprises an upper rail; a lower rail; a rotatable cylinder supporting said upper and lower rails; hydraulic means for lifting said rotatably cylinder to adjust the height of said tong assembly means for different well heads.

15. The system according to claim 14 including means mounting said tong means on said upper rail for movement toward or away from said tubular string.

16. The system according to claim 15 in which said mounting means comprises a carrier mounted on said upper rail.

17. The system according to claim 16 in which said backup clamp means is mounted on said carrier for movement with said tong means.

18. The system according to claim 17 including slip mounting means mounting said slip clamping means on said lower rail for movement toward or away from a well head.

19. The system according to claim 18 in which said slip mounting means comprises a carrier mounted on said lower rail; and means for moving said carrier forward or backward on said rail.

20. The system according to claim 11 in which said slip means comprises; a lower housing having a conical shaped cavity; a conical shaped mandrel constructed to fit said cavity; a plurality of axially movable slugs mounted in slots in said conical shaped mandrel; said axially movable slugs being movable toward an axis through said lower housing and said conical shaped mandrel when said conical shaped mandrel is pressed into said conical shaped cavity; whereby said slugs clamp a tubular passing through said lower housing and said conically shaped cavity.

21. The system according to claim 20 including hydraulic means for pressing said conical shaped mandrel into said conically shaped cavity in said housing.

22. The system according to claims 21 including release means for releasing a tubular comprising; a proximity switch mounted on a base of said slip means; said proximity switch releasing said tubular clamped in said plurality of slugs when said slip means is lifted a predetermined distance; whereby said release means prevents release of a tubular string until said tubular string is securely gripped and lifted by a hoisting block and a clamping elevator.

23. The system according to claim 22 including a clamping elevator for clamping on a tubular string; a hoisting block for lifting said clamping elevator with said tubular string; and interchangeable means in said clamping elevator to change said clamping elevator from a rod clamping means to a pipe clamping means.

24. The system according to claim 23 in which said interchangeable means comprises; a pair of pivotally hinged plates mounted on said clamping elevator; said pivotally hinged plates forming an aperture sized for clamping and lifting a rod string or a pipe string.

25. The system according to claim 24 including manual lifting means for lifting one of said interchangeable pivotally hinged plates to manual release a string from said clamping elevator.

26. The system according to claim 25 in which said elevator has a rectangular recess; said pivotally hinged plates constructed to fit said rectangular recess; and pin means passing through opposite ends of said pair of pivotally mounted plates to hingedly secure said pivotally mounted plates in said rectangular recess.

27. The system according to claim 11 including automatic positioning means for positioning said tong assembly during deployment over a well head.

28. The system according to claim 2 in which said automatic positioning means comprises a proximity switch mounted on said hydraulically operated carrier and target means mounted on said slip moving means whereby said tong assembly automatically stops over the position of said slips during deployment.

* * * * *

UNITED STATES PATENT AND TRADEMARK OFFICE

CERTIFICATE OF CORRECTION

PATENT NO. : 5,988,299

DATED : November 23, 1999

INVENTOR(S) : James Hansen, et. al.

It is certified that error appears in the above-identified patent and that said Letters Patent is hereby corrected as shown below:

Column 1, line 4, change "1997" to -- 1995 --;
Column 4, line 7, change "Fig. 2" to -- Fig. 1 --;
Column 16, Claim 28, line 1, change "claim 2" to -- claim 27 --.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*